US005607253A

United States Patent [19]

Almström

[11] Patent Number: 5,607,253

[45] Date of Patent: Mar. 4, 1997

[54] DILATATION JOINT ELEMENT

[75] Inventor: Olof Almström, Täby, Sweden

[73] Assignee: Intermerc KB, Taby, Sweden

[21] Appl. No.: 433,431

[22] PCT Filed: Nov. 9, 1993

[86] PCT No.: PCT/SE93/00948

§ 371 Date: May 5, 1995

§ 102(e) Date: May 5, 1995

[87] PCT Pub. No.: WO94/11579

PCT Pub. Date: May 26, 1994

[30] Foreign Application Priority Data

Nov. 10, 1992 [SE] Sweden ..... 9203355

[51] Int. Cl.[6] ..... E01C 11/10; E01D 19/06

[52] U.S. Cl. ..... 404/47; 404/49; 404/66; 404/68; 404/69; 52/396.05; 52/396.06

[58] Field of Search ..... 14/73.1; 404/47, 404/67, 68, 69, 49, 64, 66; 52/396.03, 396.04, 396.05, 396.06

[56] References Cited

U.S. PATENT DOCUMENTS

| | | | |
|---|---|---|---|
| 2,198,084 | 4/1940 | Jacobson | 404/69 |
| 3,124,047 | 3/1964 | Graham | 404/47 |
| 3,355,846 | 12/1967 | Tillson | 52/396.06 X |
| 3,422,733 | 1/1969 | Connell | 404/67 |
| 3,447,430 | 6/1969 | Gausepohl | 404/69 |
| 3,722,379 | 3/1973 | Koester | 404/68 |
| 3,849,958 | 11/1974 | Balzer et al. | 52/396.05 |
| 5,365,713 | 11/1994 | Nicholas et al. | 52/396.04 X |

FOREIGN PATENT DOCUMENTS

| | | | |
|---|---|---|---|
| 78191 | 5/1962 | France | 404/67 |
| 235974 | 3/1967 | Germany . | |
| 381297 | 12/1975 | Sweden . | |
| 427679 | 4/1983 | Sweden . | |
| 450018 | 6/1987 | Sweden . | |

*Primary Examiner*—James A. Lisehora

*Attorney, Agent, or Firm*—Levisohn, Lerner, Berger & Langsam

[57] ABSTRACT

To avoid leakage in concrete structures with dilatation joints and to prevent dirt from accumulating in the joints there has been developed a dilatation joint element which is easy to mount, reliable and essentially maintenance-free. The dilatation joint element according to the invention is comprised of opposed, longitudinal angle elements interconnected in pairs and made of metal with interposed jointing compound, reinforcement bands and robber elements. With curved band sections and rubber elements between the angle elements and a curved jointing compound section which is attached to the upper band section there is provided a supporting, power-compensating and power-distributing function when the joint is subjected to load, both at compression, expansion and shearing, providing a tight, reliable and loadable joint with good fatigue strength.

10 Claims, 2 Drawing Sheets

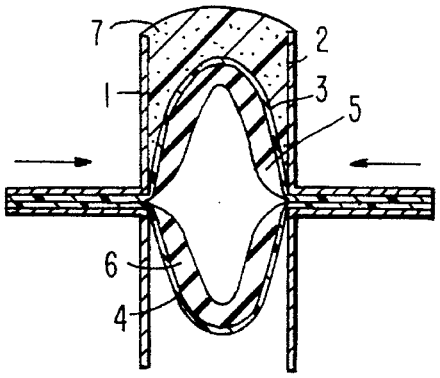
FIG.3
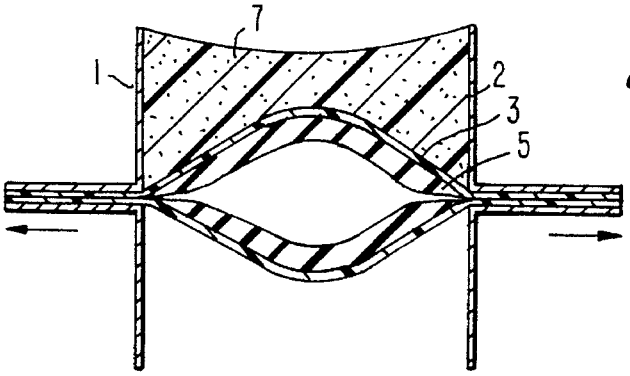
FIG. 4
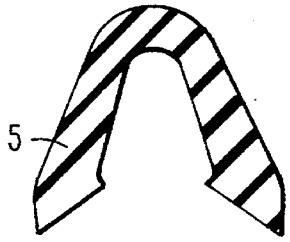
FIG. 7
FIG. 5
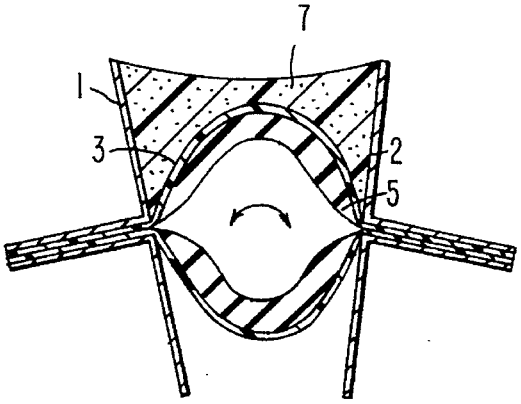
FIG. 6
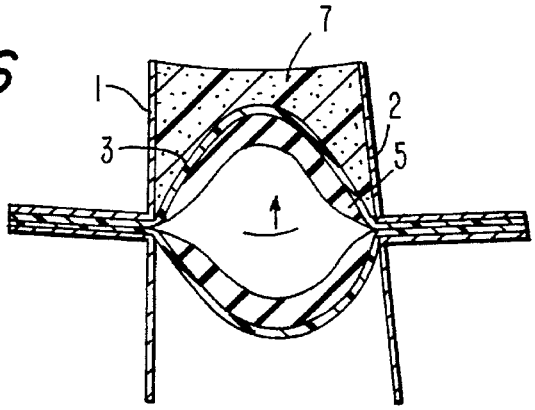

DILATATION JOINT ELEMENT

DESCRIPTION

1. Technical Field

The present invention relates to a dilatation Joint element for forming a surface joint between two structural members of, for example, cement concrete for use in joining, for example, structural members such as roadway sections in bridges and parking garages.

2. Prior Art

The reason why dilatation joints are required in cement concrete structures is that is is desired to avoid detrimental crack formation in finished structural members. In cement concrete internal stresses may arise which, when they become too intense, will gradually cause the concrete to crack. By providing openings between structural members, for example, between concrete blocks, crack formation will be located at the openings. Therefore, so called dilatation openings are provided between the blocks in a concrete structure, which dilatation openings are often joined and covered by some kind of sealing joint structure.

The joints may be of the butt type or may be flexible, depending on field of application. Butt joints, or working joints, are utilized to facilitate the casting process. Flexible joints, or dilatation joints, are utilized to minimize detrimental crack formation.

Cement concrete is a changeable material. When losing water, the concrete contracts and it is also affected by variations in temperature which in our Swedish climate may imply considerable temperature differences. Further, so called creep occurs, the extent of which depends on the load applied to the concrete over a certain period of time. Linear expansion is often related to a fixed coefficient defined by the material itself. The movement of the concrete is thus influenced by a number of factors which together give a total movement of a structural member of concrete, which again may affect the entire structure of which the structural member forms part.

Besides absorbing said movements, the dilatation joint should be sealing and should transmit forces between structural members such as concrete blocks. Sealing is required for preventing water containing, for instance, salt and other substances detrimental to the concrete from penetrating and leaching the concrete and from damaging the reinforcements, if any. Should water leakage occur in a joint, water which has become alcalic through contact with the concrete could damage underlying materials, for instance in a parking garage, and cause damage to the paint of cars. Further, infiltrating water could cause frost erosion and crack formation. In order to be durable, a joint must be tight and must be able to withstand mechanical influence of various kinds as well as considerable temperature differences.

There are previously known a variety of joint structures for joining dilatation openings, in which either some kind of jointing compound or a prefacricated dilatation joint is used.

SUMMARY OF THE INVENTION

To avoid leakage in concrete structures with dilatation joints and to prevent dirt from accumulating in the joints, a dilatation joint element has been developed which is easy to mount, reliable and essentially maintenance-free. With a horizontal, planar upper surface there will be no accumulation of dirt which would make the joint butt, and the use of a snow plough is made possible. The dilatation joint element according to the invention consists of opposed, longitudinal angle elements interconnected in pairs and made of metal with interposed jointing compound, reinforcement bands and rubber elements. The dilatation joint is secured between concrete blocks by means of casting. The jointing compound is arranged to be connected with the upper vertical angle elements. Reinforcement bands are attached between the angle elements interconnected in pairs, surrounding one or more rubber elements between the opposed angle elements interconnected in pairs, the upper band being connected with the jointing compound between the angle elements. With this type of structure there is provided essentially curved band sections between the angle elements interconnected in pairs, as well as a curved jointing compound section which is attached to the upper band section. With rubber elements (rubber fenders) disposed opposite each other in pairs between the reinforcement bands there is provided a supporting, power-compensating and power-distributing function when the joint is subjected to load, both at compression, expansion and shearing, which gives a tight, reliable and loadable joint with good fatigue strength.

DESCRIPTION OF THE DRAWINGS

FIG. 3 is a cross sectional view of the dilatation joint under compression;

FIG. 4 is a cross sectional view of the dilatation joint in expansion;

FIG. 5 is a cross sectional view of the dilatation joint in shearing;

FIG. 6 is a cross sectional view of the dilatation joint mounted in an angled position, and FIG. 7 is a cross sectional view showing a suitable rubber fender formed as a yielding element.

DESCRIPTION OF AN EMBODIMENT

Figure 1:
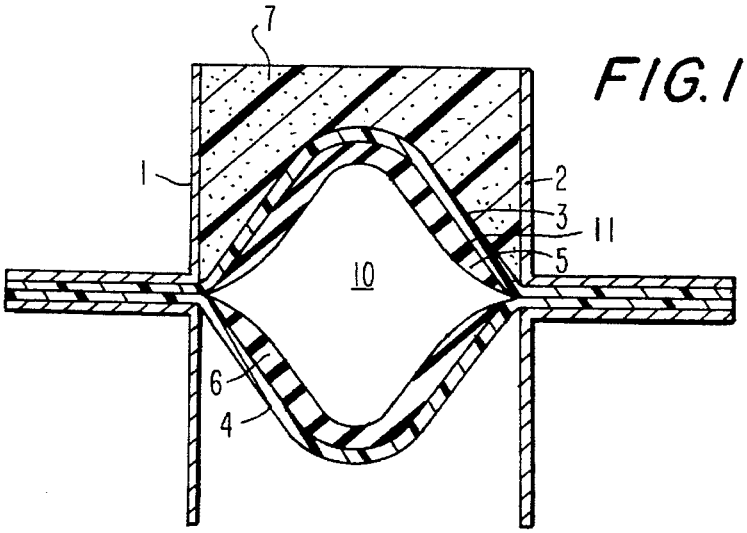
FIG. 1 is a cross sectional view of a dilatation joint according to the invention.
Figure 2:
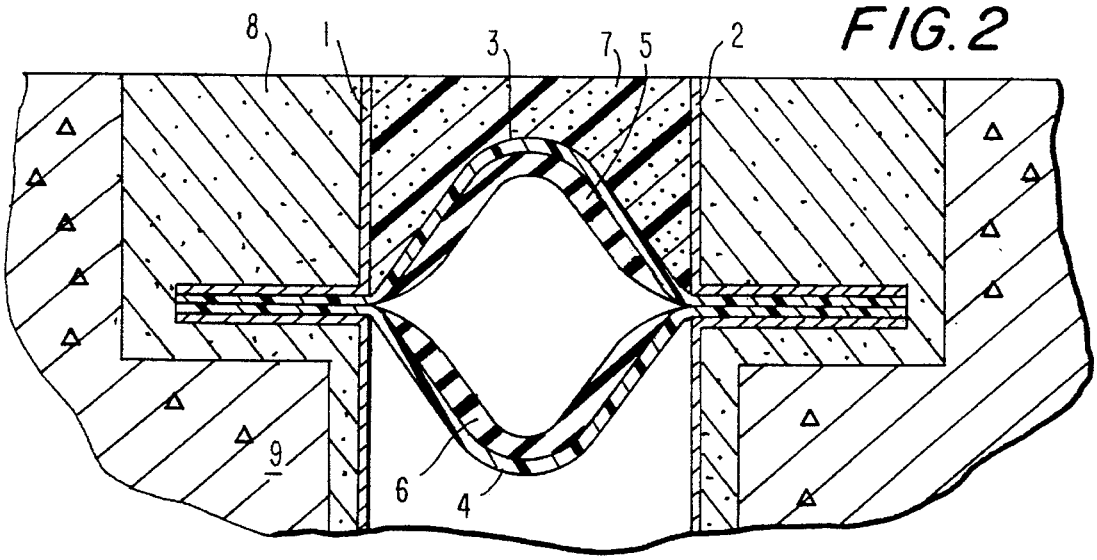
FIG. 2 is a cross sectional view showing the dilatation joint in FIG. 1 mounted between two concrete elements.

In FIG. 2 there is shown a dilatation joint mounted between two structure elements, such as two cement concrete blocks for a bridge deck. The dilatation joint is comprised of angle elements 1, 2 of, for instance, light metal or steel (30×30×1,5 mm) arranged in pairs opposite each other. An upper and a lower reinforcement band 3, 4 are mounted between the angle elements 1, 2 arranged in pairs opposite each other and are disposed such as to limit an inner, curved space 10 which can accomodate a tubular element or two or more interacting flexibly yielding elements 5, 6 of rubber, such as rubber fenders made of EPDM rubber with a hardness of 70° Shore. The material of the reinforcement bands 3, 4 may be laminated, synthetic fibre reinforced polymerized PVC, such as Sikaplan® PVC 12 BDWT/15 VDWT. Two rubber fenders 5, 6 acting against one another are preferably used, which are curved and supporting relative to the upper and lower bands. Between the upper vertical portions of the angle elements and the upper curved band there is interposed a jointing compound 7 of a hardness of, for example, 35° Shore. The jointing compound material may be a self-levelling polyurethane jointing compound, such as Sikaflex 35 SL.

The outer ends of the angle elements arranged in pairs opposite each other are mounted in recesses in the concrete blocks 9 by means of an epoxy cement 8, such as Sikadur.

Optionally, the angle elements may be attached to the concrete blocks by means of screws, however, in order to avoid crack formation it is preferred to provide holes in the angle elements which during attachment are filled with epoxy cement so as to form an additional attachment by means of the epoxy cement in the recess. Between reinforcement bands and rubber fenders there may be arranged an adhesive 11 such as flexible polyurethane jointing compound, for instance, Sikaflex-11FC, and optionally a plastic film between reinforcement bands and jointing compound.

With said dilatation joint structure there is provided a jointing compound acting with reinforcement bands and rubber fenders for the best possible connection, carrying capacity, tightness, and flexibility with decreased risk of ruptures and crack formation. The structure permits shearing and essentially permanent bending of the joint with or without adaption of the gap width. Seen in cross section, the jointing compound, the reinforcement band and the rubber fenders together form a structural member which during expansion, see FIG. 4, with weakening in the centre and increasing torsional stress, is able to withstand this by retaining its mounting height and by increased resistance from the rubber fenders compressed by the bands. At compression, see FIG. 3, the laterally compressed rubber fenders together with the reinforcement bands will control deformation of the jointing compound and cause bulging of the same. In the case of shearing and irregular dilatation, see FIG. 5, the interacting elements of the dilatation joint may together provide a flexibility at essentially maintained carrying capacity. In the case of angular deformation only, see FIG. 6, the dilatation joint may be adapted by mounting it in a curved or angled position and by adapting the jointing compound filling accordingly. FIG. 7 shows in cross section an example of a suitable rubber fender with a narrow centre portion and wide end portions for good supporting effect during expansion.

The dilatation joints may be manufactured in different lengths so that they can be mounted without lengthening. If dilatation joint elements are to be lengthened, the end portions may be formed as male and female parts with extended rubber fenders at one end and shortened rubber fenders at the other end. In the case of lengthening, the ends will then be inserted into each other and an adhesive band is attached over the reinforcement band ends, and jointing compound is then filled between the vertical portions of the angle elements. With this kind of dilatation joint it is also possible to join several elements in a T-shape or cruciform shape by means of T-shaped or cruciform connection elements, which are arranged to be connected to the respective ends of the dilatation joint elements. By selecting softer or harder jointing compound and/or weaker or stronger rubber fenders, the dilatation joint may be adapted to be either softer or harder, as required. Instead of rubber fenders it is possible to insert rubber hoses or a cylindrical rim of, for instance, neoprene.

I claim:

1. A dilatation joint element for joining structural members, comprising:

a jointing compound section connected between mounting elements (1, 2) and carried by a reinforcement band supported by a yielding means, wherein said reinforcement band and said yielding means together form a curved shape acting against said jointing compound section, said yielding means comprising an upper upwardly oriented part (5) of curved shape and a lower downwardly oriented part (6) of curved shape together forming a closed shape with an open center, said reinforcement band comprising an upper reinforcement band and a lower reinforcement band (3, 4) which surround said closed shape and are provided between said mounting elements (1, 2).

2. A dilatation joint element according to claim 1, wherein said yielding means comprises a plurality of interacting curved upwardly and downwardly oriented shaped parts (5, 6) together forming an essentially closed shape with an open center, said closed shape being surrounded by said upper and said lower reinforcement bands (3, 4) provided between said mounting elements (1, 2).

3. A dilatation joint element according to claim 2, wherein said interacting curved upwardly and downwardly oriented shaped parts (5, 6) comprise two curved robber profiles with a narrow center portion and wide end portions, said rubber profiles being oriented outwardly from one another.

4. A dilatation joint element according to claim 1, wherein said mounting elements have upper portions, and said jointing compound section (7) is connected with said tipper portions of said mounting elements (1, 2) and with said upper reinforcement band (3).

5. A dilation joint element according to claim 1, wherein said mounting elements (1, 2) are arranged in pairs opposite each other and comprise vertical upper and lower portions.

6. A dilatation joint element according to claim 1, wherein said mounting elements (1, 2) comprise horizontal portions which am provided with holes.

7. A dilatation joint element according to claim 1, wherein said jointing compound comprises a self-levelling polyurethane jointing compound.

8. A dilatation joint element according to claim 1, wherein said upper and lower reinforcement bands comprise laminated, synthetic fiber reinforced polymerized PVC.

9. A dilatation joint element according to claim 1, wherein said yielding means comprise rubber elements.

10. A dilatation joint element according to claim 1, wherein said jointing compound comprises a self-levelling polyurethane jointing compound, said upper and lower reinforcement bands comprise laminated, synthetic fiber reinforced polymerized PVC, and said yielding means comprise rubber elements.

* * * * *